US008991346B2

(12) United States Patent
Kinouchi

(10) Patent No.: US 8,991,346 B2
(45) Date of Patent: Mar. 31, 2015

(54) VALVE TIMING CONTROL APPARATUS

(71) Applicant: Denso Corporation, Kariya, Aichi-pref. (JP)

(72) Inventor: Soichi Kinouchi, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 14/097,205

(22) Filed: Dec. 4, 2013

(65) Prior Publication Data

US 2014/0150742 A1 Jun. 5, 2014

(30) Foreign Application Priority Data

Dec. 4, 2012 (JP) ..... 2012-265449

(51) Int. Cl.
*F01L 1/34* (2006.01)
*F01L 1/344* (2006.01)

(52) U.S. Cl.
CPC ..... *F01L 1/3442* (2013.01); *F01L 2001/34446* (2013.01); *F01L 2001/34426* (2013.01); *F01L 2001/34433* (2013.01)
USPC ..... 123/90.17

(58) Field of Classification Search
CPC ..... F01L 2001/34496; F01L 2001/3443; F01L 2001/34426; F01L 2001/34446; F01L 1/3442; F01L 2001/34433; F01L 2001/34493
USPC ..... 123/90.17
See application file for complete search history.

(56) References Cited

U.S. PATENT DOCUMENTS

| | | | | |
|---|---|---|---|---|
| 2003/0070643 | A1 | 4/2003 | Watanabe et al. | |
| 2006/0242970 | A1 | 11/2006 | Yang et al. | |
| 2007/0095315 | A1 | 5/2007 | Hoppe et al. | |
| 2008/0236529 | A1 | 10/2008 | Scheidig et al. | |
| 2013/0199469 | A1 * | 8/2013 | Busse et al. | 123/90.15 |

OTHER PUBLICATIONS

Office Action (2 pages) dated Oct. 17, 2014, issued in corresponding Japanese Application No. 2012-265449 and English translation (3 pages).

* cited by examiner

*Primary Examiner* — Thomas Denion
*Assistant Examiner* — Daniel Bernstein
(74) *Attorney, Agent, or Firm* — Nixon & Vanderhye PC

(57) ABSTRACT

A hydraulic pressure control valve is received in a center hole of a vane rotor that is rotatable relative to a housing. A first tubular portion and a second tubular portion are fitted with each other to form an oil accumulation chamber. The oil accumulation chamber accumulates at least one of oil outputted from a gap between the housing and the vane rotor, and oil discharged from an oil passage communicated with the advancing chamber or the retarding chamber.

9 Claims, 9 Drawing Sheets

VALVE TIMING CONTROL APPARATUS

CROSS REFERENCE TO RELATED APPLICATION

This application is based on and incorporates herein by reference Japanese Patent Application No. 2012-265449 filed on Dec. 4, 2012.

TECHNICAL FIELD

The present disclosure relates to a valve timing control apparatus, which controls opening timing and closing timing of intake valves or exhaust valves of an internal combustion engine.

BACKGROUND

A known valve timing control apparatus controls opening timing and closing timing of intake valves or exhaust valves by changing a rotational phase between a crankshaft and a camshaft of an internal combustion engine installed in, for example, a vehicle.

JP2009-515090A (corresponding to US2007/0095315A1) recites a valve timing control apparatus that includes a hydraulic pressure control valve, which is installed in a vane rotor that is rotatable relative to a housing. More specifically, the hydraulic pressure control valve is installed in a center hole of the vane rotor, which extends in a direction of a rotational axis of the vane rotor. The hydraulic pressure control valve shifts from one oil passage to another oil passage to supply the oil, which is received from an oil pump, to advancing chambers or retarding chambers formed in the housing. In this way, the valve timing control apparatus can advance or retard the vane rotor relative to the housing.

However, the hydraulic pressure control valve of JP2009-515090A (corresponding to US2007/0095315A1) has an output port at a location that is projected from the center hole of the vane rotor to the outside of the housing. Therefore, in the hydraulic pressure control valve, the oil of the retarding chambers is discharged from the output port to the outside of the housing at the time of supplying the oil to the advancing chambers. Also, the oil of the advancing chambers is discharged from the output port to the outside of the housing at the time of supplying the oil to the retarding chambers. Therefore, it is difficult to use a drive belt, such as a toothed belt, a flat belt or a V-belt, in a drive force transmission mechanism located between the crankshaft of the engine and the housing in the valve timing control apparatus.

SUMMARY

The present disclosure is made in view of the above points. According to the present disclosure, there is provided a valve timing control apparatus that controls opening timing and closing timing of one of an intake valve and an exhaust valve of an internal combustion engine, which is opened and closed by a driven-side shaft of the internal combustion engine, through changing of a rotational phase between a driving-side shaft of the internal combustion engine and the driven-side shaft. The valve timing control apparatus includes a housing, a vane rotor, a hydraulic pressure control valve, a solenoid, a first tubular portion and a second tubular portion. The housing is rotatable integrally with the driving-side shaft. The vane rotor is rotatable relative to the housing according to a hydraulic pressure of an advancing chamber formed in the housing and a hydraulic pressure of a retarding chamber formed in the housing. The vane rotor is fixed to the driven-side shaft. The hydraulic pressure control valve includes a sleeve and a spool. The sleeve is received in a center hole of the vane rotor, which extends in a direction of a rotational axis of the vane rotor. The spool is received in an inside of the sleeve and is configured to reciprocate along the sleeve. The hydraulic pressure control valve changes a hydraulic pressure, which is supplied to or is discharged from the advancing chamber, and a hydraulic pressure, which is supplied to or is discharged from the retarding chamber, through movement of the spool. The solenoid includes a solenoid main body and a press pin. The solenoid main body is opposed to the housing. The press pin projects from the solenoid main body and is configured to press the spool of the hydraulic pressure control valve. The solenoid controls the changing of the hydraulic pressures at the hydraulic pressure control valve. The first tubular portion extends from the housing toward the solenoid. The second tubular portion extends from the solenoid main body or an installation member, to which the solenoid main body is installed, toward the housing and is fitted to the first tubular portion. The second tubular portion cooperates with the first tubular portion to form an oil accumulation chamber that is configured to accumulate at least one of oil outputted from a gap between the housing and the vane rotor, and oil discharged from an oil passage communicated with the advancing chamber or the retarding chamber.

BRIEF DESCRIPTION OF THE DRAWINGS

The drawings described herein are for illustration purposes only and are not intended to limit the scope of the present disclosure in any way.

FIG. 9 is an enlarged partial cross-sectional view of a main feature shown in

FIG. 7.

DETAILED DESCRIPTION

Figure 1:
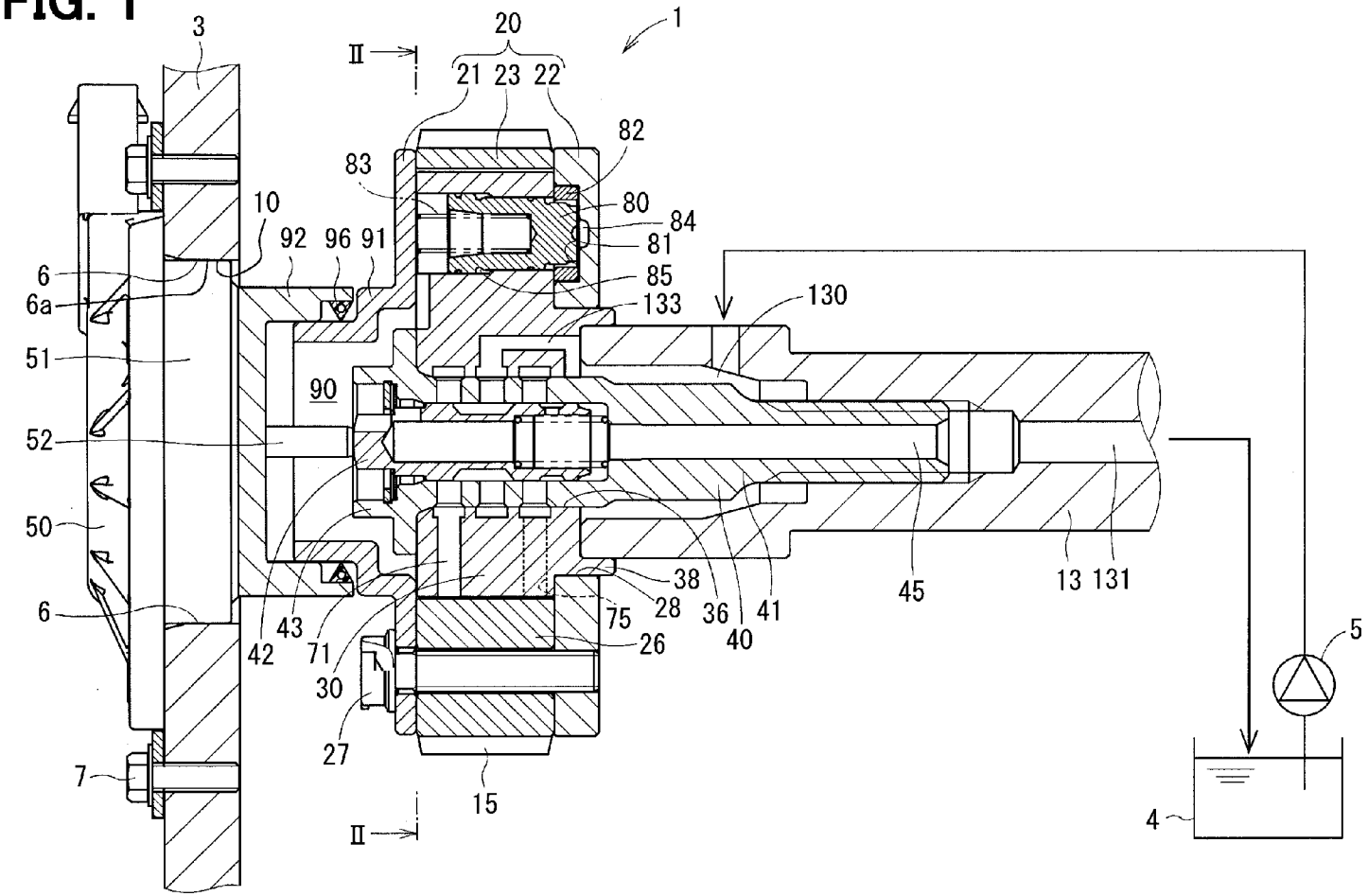
FIG. 1 is a longitudinal cross sectional view of a valve timing control apparatus according to a first embodiment of the present disclosure.

Various embodiments of the present disclosure will be described with reference to the accompanying drawings.

First Embodiment

FIGS. 1 to 4 show a first embodiment of the present disclosure. A valve timing control apparatus 1 of the present embodiment is used in a drive force transmission mechanism of an internal combustion engine 2 of a vehicle (e.g., an automobile) shown in FIG. 3. The drive force transmission mechanism is placed in an inside of an engine cover 3. In the drive force transmission mechanism, a drive belt 17 is would around a pulley 12, a pulley 15 and a pulley 16. The pulley 12 is fixed to a crankshaft 11, which serves as a driving-side shaft of the engine 2. The pulley 15 is fixed to a camshaft 13, which serves as a driven-side shaft, and the pulley 16 is fixed to a camshaft 14, which serves as a driven-side shaft. A torque of the crankshaft 11 is transmitted to the camshafts 13, 14 through the drive belt 17. The camshaft 13 drives intake valves 18 to open and close the intake valves 18. The camshaft 14 drives exhaust valves 19 to open and close the exhaust valves 19. In the valve timing control apparatus 1 of the first embodiment, the pulley 15 is connected to the drive belt 17, and a vane rotor 30 is connected to the camshaft 13. The crankshaft 11 and the camshaft 13 are rotated such that a predetermined phase difference is formed between the crankshaft 11 and the camshaft 13, and thereby the opening timing and the closing timing of the intake valves 18 are controlled.

Figure 3:
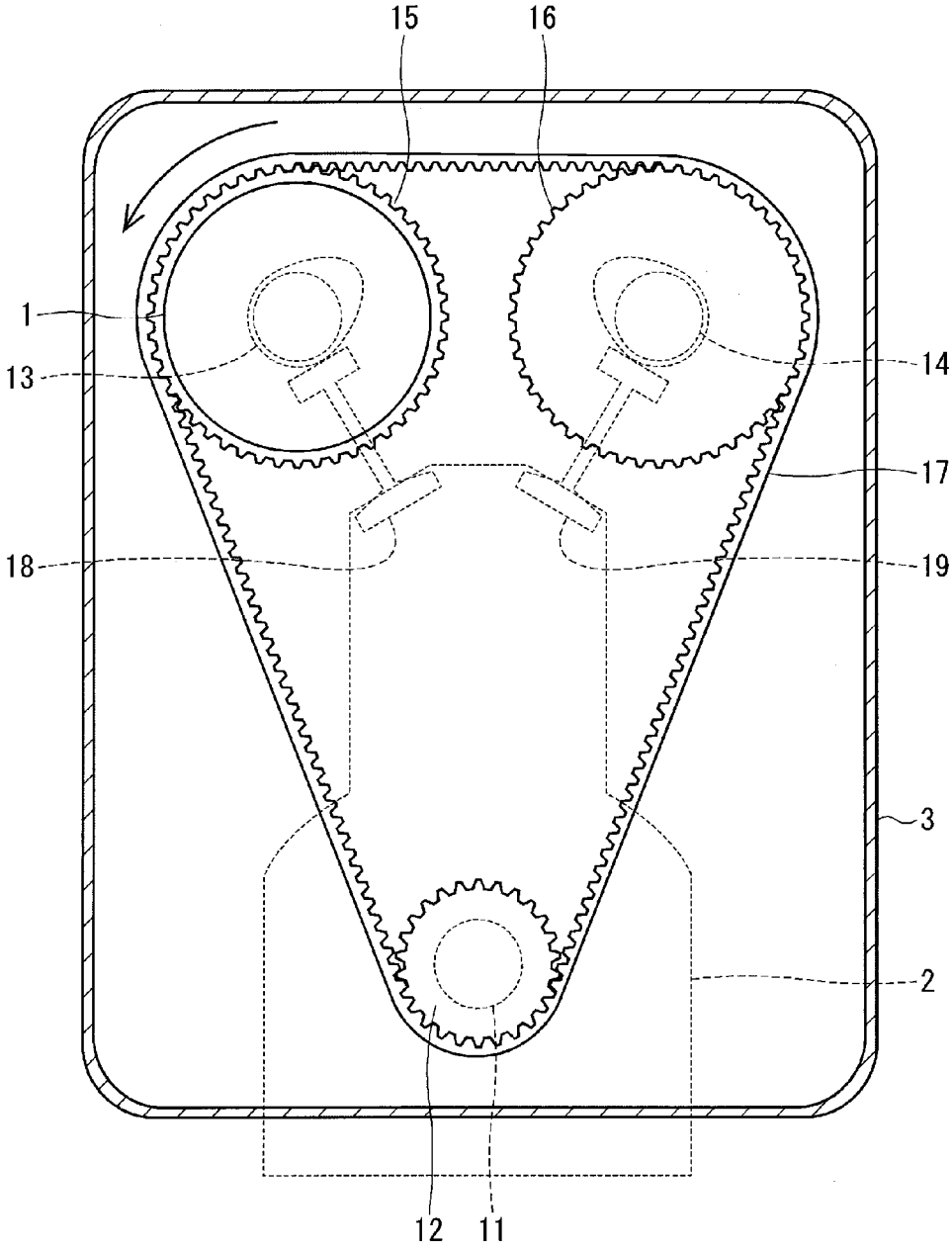
FIG. 3 is a schematic view showing a structure of a drive force transmission mechanism, in which the valve timing control apparatus of the first embodiment is used.

An arrow shown in FIG. 3 indicates a rotational direction of the drive belt 17.

Figure 2:
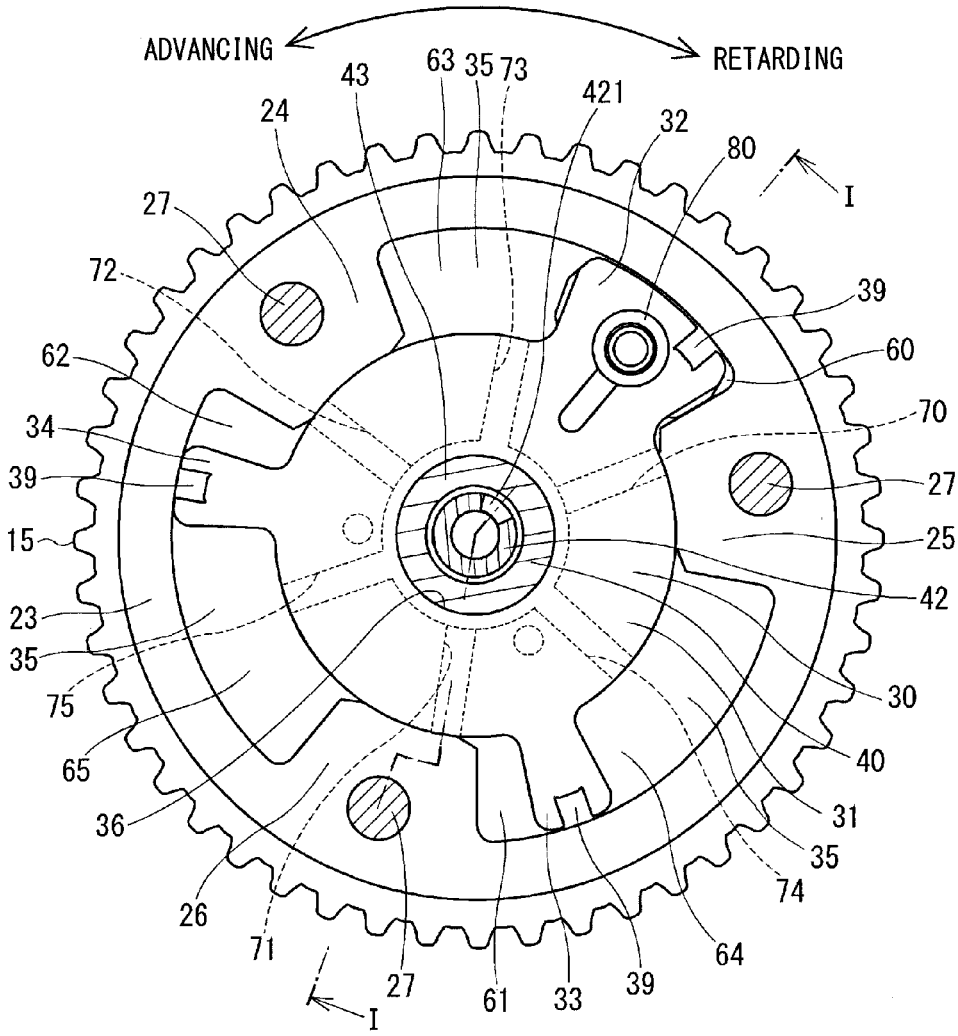
FIG. 2 is a cross-sectional view taken along line II-II in FIG. 1.

As shown in FIGS. 1 and 2, the valve timing control apparatus 1 includes a housing 20, the vane rotor 30, a hydraulic pressure control valve 40 and a solenoid 50.

The housing 20 includes a front plate 21, a rear plate 22, a tubular portion 23 and shoes 24-26. The front plate 21, the rear plate 22 and the tubular portion 23 are held together by bolts 27.

The front plate 21 is configured into an annular form (a ring form). A first tubular portion 91, which is configured into a cylindrical tubular form, axially extends from a radially inner end of the front plate 21 on an axial side where the solenoid 50 is located. The front plate 21 is formed integrally with the first tubular portion 91.

The rear plate 22 is configured into an annular form and is axially opposed to the front plate 21 such that the vane rotor 30 is axially held between the rear plate 22 and the front plate 21. The rear plate 22 has a rear hole 28, into which a rear bushing 38 of the vane rotor 30 is received.

The tubular portion 23 and the shoes 24-26 are integrally formed and are held between the front plate 21 and the rear plate 22 in the axial direction. The shoes 24-26 are arranged one after another at predetermined intervals in a circumferential direction of the tubular portion 23 and extend radially inward from the tubular portion 23. A hydraulic pressure chamber 35, which has a fan-shaped cross-section, is formed between each circumferentially adjacent two of the shoes 24-26.

The drive belt 17 is wound around the pulley 15, which is formed in the outer peripheral part of the tubular portion 23, so that the housing 20 is rotated integrally with the crankshaft 11.

The vane rotor 30 is rotatable relative to the housing 20. The vane rotor 30 includes a rotor (also referred to as a boss) 31, a rear bushing 38 and a plurality of vanes 32-34. The rotor 31 is configured into a cylindrical tubular form. The rear bushing 38 axially extends from the rotor 31. The vanes 32-34 radially outwardly extend from the rotor 31.

Each outer peripheral wall portion of the rotor 31, which is circumferentially placed between corresponding adjacent two of the vanes 32-34, is fluid-tightly slidable along an inner peripheral wall portion of a corresponding one of the shoes 24-26 of the housing 20. The rotor 31 has a center hole 36, which extends in a direction of a rotational axis of the rotor 31 at a center of the rotor 31. The center hole 36 axially receives a hydraulic pressure control valve 40.

The rear bushing 38 is configured into a tubular form and extends from the rotor 31 into the rear hole 28 of the rear plate 22. The rear bushing 38 and the camshaft 13 are fluid-tightly fixed with each other. The rear bushing 38 is rotatable relative to the rear hole 28 of the rear plate 22.

Each of the vanes 32-34 partitions a corresponding one of the hydraulic pressure chambers 35 of the housing 20 into an advancing chamber 60-62 and a retarding chamber 63-65. The hydraulic pressure is supplied to or is discharged from the advancing chambers 60-62 through advancing oil passages 70-72. Also, the hydraulic pressure is supplied to or is discharged from the retarding chambers 63-65 through retarding oil passages 73-75.

A seal member 39 is installed to an outer peripheral wall portion of each of the vanes 32-34. The seal member 39 limits the flow of the oil between the corresponding advancing chamber 60-62 and the corresponding retarding chamber 63-65, which are located on one circumferential side and the other circumferential side, respectively, of the vane 32-34 having the seal member 39. The vane rotor 30 is rotatable relative to the housing 20 according to the hydraulic pressure of the advancing chambers 60-62 and the hydraulic pressure of the retarding chambers 63-65.

A counterclockwise arrow and a clockwise arrow shown in FIG. 2 indicate the advancing direction and the retarding direction, respectively, of the vane rotor 30 relative to the housing 20.

A stopper piston 80 is received in a hole of the vane rotor 30 in a manner that enables axial reciprocation of the stopper piston 80. A ring 82 is received in a recess 81 of the rear plate 22, and the stopper piston 80 can be fitted into or removed from the ring 82 upon the reciprocation of the stopper piston 80. The stopper piston 80 can be fitted into the ring 82 by an urging force of a spring 83 when the vane rotor 30 is placed in a most retarded position relative to the housing 20.

A first pressure chamber 84 and a second pressure chamber 85 are formed around the stopper piston 80. One of the first pressure chamber 84 and the second pressure chamber 85 is communicated with the retarding chambers 63-65, and the other one of the first pressure chamber 84 and the second pressure chamber 85 is communicated with the advancing chambers 60-62.

When a sum of the hydraulic pressure of the first pressure chamber 84 applied to the stopper piston 80 and the hydraulic pressure of the second pressure chamber 85 applied to the stopper piston 80 becomes larger than the urging force of the spring 83, the stopper piston 80 is removed from the ring 82.

The hydraulic pressure control valve 40 includes a sleeve 41 and a spool 42. The sleeve 41 is configured into a tubular bolt form. The spool 42 is received in the sleeve 41.

The sleeve 41 extends through the center hole 36 of the vane rotor 30 and is threadably engaged with a female-thread of the camshaft 13, and a head 43 of the sleeve 41 contacts the vane rotor 30. In this way, the camshaft 13, the vane rotor 30 and the sleeve 41 are fixed together.

Figure 4:
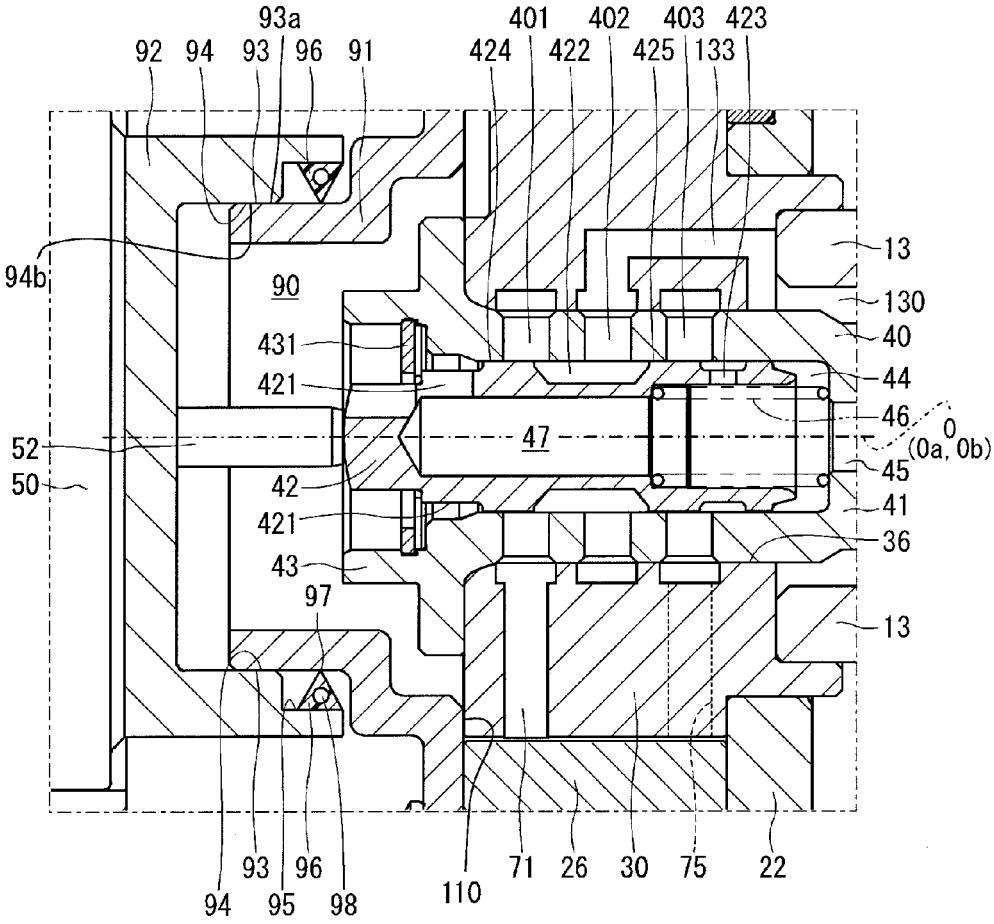
FIG. 4 is a partial enlarged cross-sectional view of a portion of FIG. 1.

As shown in FIGS. 1 and 4, the sleeve 41 has a first port 401, a second port 402 and a third port 403, which radially extend through an outer peripheral wall of the sleeve 41 and are axially arranged one after another in this order from the head 43 side of the sleeve 41. Furthermore, the sleeve 41 has a slide chamber 44 and an axial passage 45. The slide chamber 44 axially receives the spool 42. The axial passage 45 communicates between the slide chamber 44 and an oil discharge passage (also referred to as a first oil discharge passage) 131 of the camshaft 13.

The first port 401 is communicated with the advancing oil passages 70-72 of the vane rotor 30.

The second port 402 is communicated with a supply passage 133 of the vane rotor 30. The supply passage 133 of the vane rotor 30 is communicated with a hydraulic pressure supply passage 130 of the camshaft 13. Thereby, the oil, which is pumped by an oil pump 5 from an oil pan 4 of the vehicle, is supplied to the second port 402 through the supply passage 133 of the vane rotor 30 and the hydraulic pressure supply passage 130 of the camshaft 13.

The third port 403 is communicated with the retarding oil passages 73-75 of the vane rotor 30.

The spool 42 is received in the slide chamber 44 of the sleeve 41 in a manner that enables reciprocation of the spool 42 in the axial direction. A stopper ring 431, which is installed to the head 43 of the sleeve 41, limits removal of the spool 42 from the slide chamber 44 of the sleeve 41.

A spring 46 is placed between the spool 42 and an inner wall of the slide chamber 44 of the sleeve 41. The spring 46 urges the spool 42 toward the stopper ring 431.

The spool 42 has an inside passage 47, which is formed in the inside of the spool 42. The inside passage 47 is communicated with the slide chamber 44 of the sleeve 41.

The spool 42 has a front groove and hole portion 421, a middle groove portion 422 and a rear groove and hole portion 423, which are formed in the outer peripheral wall of the spool 42 and are arranged in this order from the front side to the rear side in the axial direction.

A first land 424 is formed between the front groove and hole portion 421 and the middle groove portion 422 in the outer peripheral wall of the spool 42. A second land 425 is formed between the middle groove portion 422 and the rear groove and hole portion 423 in the outer peripheral wall of the spool 42.

The first land 424 enables and disables communication between the first port 401 and the front groove and hole portion 421. The first land 424 also enables and disables communication between the first port 401 and the middle groove portion 422.

The second land 425 enables and disables communication between the third port 403 and the middle groove portion 422. The second land 425 also enables and disables communication between the third port 403 and the rear groove and hole portion 423.

The front groove and hole portion 421 is communicated with an oil accumulation chamber (also referred to as an oil well or an oil pool) 90 and the inside passage 47. In this way, the oil accumulation chamber 90 is communicated with the oil discharge passage 131 of the camshaft 13 through the front groove and hole portion 421, the inside passage 47, the slide chamber 44 and the axial passage 45.

The front groove and hole portion 421, the inside passage 47, the slide chamber 44 and the axial passage 45 form a communication passage 100 that communicates between the oil accumulation chamber 90 and the oil discharge passage 131.

The middle groove portion 422 communicates between the first port 401 and the second port 402 or communicates between the second port 402 and the third port 403.

The rear groove and hole portion 423 is communicated with the inside passage 47.

The solenoid 50 is installed to an installation hole 6 of the engine cover 3 with bolts 7. The engine cover 3 serves as an installation member, to which a solenoid main body 51 of the solenoid 50 is installed. Besides the solenoid main body 51, the solenoid 50 further includes a press pin 52. The press pin 52 projects from the solenoid main body 51. A small gap 10 is formed between the solenoid main body 51 and an inner peripheral wall 6*a* of the installation hole 6. This gap 10 is used to coaxially align the solenoid 50 and the housing 20 with each other, i.e., to enable adjustment of the alignment between a rotational axis Oa of the housing 20 and a central axis Ob of the press pin 52.

The solenoid main body 51 is operated through energization from an undepicted electronic control unit (ECU) to axially drive the press pin 52. The press pin 52 can press the spool 42 toward the spring 46.

When the spool 42 is moved, the hydraulic pressure, which is supplied to the advancing chambers 60-62 and the hydraulic pressure, which is supplied to the retarding chambers 63-65, are controlled. The ECU drives the solenoid 50 to coincide the rotational phase of the vane rotor 30 relative to the housing 20 with a target rotational phase.

A second tubular portion 92, which is configured into a cylindrical tubular form, extends from the solenoid main body 51 toward the housing 20. The solenoid main body 51 and the second tubular portion 92 are integrally formed.

The second tubular portion 92 is fitted to an outer peripheral wall section (also referred to as a radially outer side section) of the first tubular portion 91. Thereby, the oil accumulation chamber 90 is formed in the inside of the first tubular portion 91 and the second tubular portion 92. The oil accumulation chamber 90 accumulates, i.e., stores the oil, which is discharged from a gap(s), such as a gap 110, formed between the housing 20 and the vane rotor 30, and/or the oil, which is discharged from the advancing oil passages 70-72 or the retarding oil passages 73-75.

The first tubular portion 91 includes a first guiding part 93, which is configured into a cylindrical tubular form. An outer peripheral wall section (also referred to as a radially outer side section) 93*a* of the first guiding part 93, which is formed as a part of the outer peripheral wall of the first tubular portion 91, slidably contacts the second tubular portion 92. The second tubular portion 92 includes a second guiding part 94, which is configured into a cylindrical tubular form. An inner peripheral wall section (also referred to as a radially inner side section) 94*b* of the second guiding part 94, which is formed as a part of the inner peripheral wall of the second tubular portion 92, slidably contacts the first tubular portion 91, more specifically, the outer peripheral wall section 93*a* of the first guiding part 93. When the first guiding part 93 and the second guiding part 94 slidably contact with each other, the rotational axis Oa of the housing 20 and the central axial Ob of the press pin 52 of the solenoid 50 are substantially placed along a common axis (a central axis) O to coaxially align the housing 20 and the solenoid 50 with each other. In this way, the press pin 52 of the solenoid 50 can reliably press the spool 42, which is placed along the rotational axis Oa of the housing 20.

The second tubular portion 92 includes a stepped part 95, which has an inner diameter that is larger than an inner diameter of the second guiding part 94. A seal member 96 is made of, for example, a resin material or a rubber material and is configured into an annular form (a ring form). The seal member 96 is fixed to the stepped part 95 of the second tubular portion 92 by, for example, press-fitting. The seal member 96 has a seal surface 97, which fluid-tightly and slidably contacts the outer peripheral wall of the first tubular portion 91. The seal member 96 includes a spring 98, which is configured into an annular form and is placed in the inside of the seal member 96. The spring 98 urges the seal surface 97 of the seal member 96 in a radially inner direction to improve the fluid-tightness between the seal surface 97 and the outer peripheral wall section of the first tubular portion 91.

Next, the operation of the valve timing control apparatus 1 will be described.

(Engine Start Time)

As shown in FIGS. 1 and 2, in a state where the engine 2 is stopped, the stopper piston 80 is receive in the inside of the ring 82, and the vane rotor 30 is held in the most retarded position relative to the housing 20. In a state immediately after starting of the engine 2, the sufficient amount of oil is not supplied to the retarding chambers 63-65, the advancing chambers 60-62, the first pressure chamber 84 and the second pressure chamber 85 (these chambers also being referred to as hydraulic chambers), so that the stopper piston 80 is maintained in the received state, in which the stopper piston 80 is received in the inside of the ring 82. Therefore, it is possible to limit generation of a hitting sound (hammering sound), which would be generated between the housing 20 and the vane rotor 30 due to a torque change applied to the camshaft 13.

(After Engine Start)

After the start of the engine 2, when the sufficient amount of oil is supplied to each hydraulic chamber from the oil pump 5, the stopper piston 80 is removed from the ring 82 against the urging force of the spring 83 by the hydraulic pressure of the first pressure chamber 84 and the hydraulic pressure of the second pressure chamber 85. Thereby, the rotation of the vane rotor 30 relative to the housing 20 is enabled.

(Time of Advancing Operation)

In the advancing operation of the valve timing control apparatus 1, the solenoid 50 receives a corresponding command from the ECU and removes (or releases) the press force of the press pin 52, which presses the spool 42 of the hydraulic pressure control valve 40 toward the spring 46. In this way, the oil is supplied from the hydraulic pressure supply passage 130 to the advancing chambers 60-62 through the second port 402, the first port 401 and the advancing oil passages 70-72. In contrast, the oil of the retarding chambers 63-65 is discharged to the inside passage 47 through the retarding oil passages 73-75, the third port 403, and the rear groove and hole portion 423. In this way, the hydraulic pressure of the advancing chambers 60-62 is applied to the vanes 32-34, and thereby the vane rotor 30 is rotated relative to the housing 20 in the advancing direction.

(Time of Retarding Operation)

In the retarding operation of the valve timing control apparatus 1, the solenoid 50 receives a corresponding command from the ECU and drives the press pin 52 to press the spool 42 of the hydraulic pressure control valve 40 toward the spring 46. In this way, the oil is supplied from the hydraulic pressure supply passage 130 to the retarding chambers 63-65 through the second port 402, the third port 403 and the retarding oil passages 73-75. In contrast, the oil of the advancing chambers 60-62 is discharged to the inside passage 47 or the oil accumulation chamber 90 through the advancing oil passages 70-72, the first port 401 and the front groove and hole portion 421. In this way, the hydraulic pressure of the retarding chambers 63-65 is applied to the vanes 32-34, and thereby the vane rotor 30 is rotated relative to the housing 20 in the retarding direction.

(Intermediate Holding Operation)

When the vane rotor 30 reaches the target phase, the hydraulic pressure control valve 40 limits the discharge of the hydraulic pressure from the retarding chambers 63-65 and the advancing chambers 60-62 to the oil pan 4. At this time, the minute amount of hydraulic pressure is supplied from the hydraulic pressure supply passage 130 to the retarding chambers 63-65 and the advancing chambers 60-62 through the retarding oil passages 73-75 and the advancing oil passages 70-72. Thereby, the vane rotor 30 is held in the target phase.

(Time of Engine Stop)

When a command, which stops the engine 2, is outputted during the operating period of the valve timing control apparatus 1, the vane rotor 30 is rotated relative to the housing 20 in the retarding direction through the operation, which is similar to the retarding operation discussed above, and the vane rotor 30 is stopped in the most retarded position. In this state, when the operation of the oil pump 5 is stopped to cause a reduction in the pressure of the first pressure chamber 84 and a reduction in the pressure of the second pressure chamber 85, the stopper piston 80 is urged into the inside of the ring 82 by the urging force of the spring 83. In this state, the engine 2 is stopped.

Now, the advantages of the first embodiment will be described.

(1) In the first embodiment, the first tubular portion 91, which extends from the housing 20, and the second tubular portion 92, which extends from the solenoid main body 51, are fitted together to form the oil accumulation chamber 90. In this way, a portion of the oil, which is discharged from the gap(s) between the housing 20 and the vane rotor 30, or the oil, which is discharge from the advancing oil passages 70-72 or the retarding oil passages 73-75, is accumulated in the oil accumulation chamber 90. Thereby, the leakage of the oil to the outside of the housing 20 can be limited in the valve timing control apparatus 1. Thus, it is possible to use the drive belt (e.g., a toothed belt, a flat belt or a V-belt) in the drive force transmission mechanism between the housing 20 and the driving-side shaft (i.e., the crankshaft 11) in the valve timing control apparatus 1.

(2) In the first embodiment, the first guiding part 93 of the first tubular portion 91 and the second guiding part 94 of the second tubular portion 92 slidably contact with each other, so that the rotational axis Oa of the housing 20 and the central axis Ob of the press pin 52 of the solenoid 50 are substantially coaxially aligned along the common axis O. In this way, the press pin 52 can reliably contact the center (the central axis) of the spool 42, so that the hydraulic pressure control valve 40 can be reliably controlled by the solenoid 50.

(3) In the first embodiment, the seal member 96 is placed between the first tubular portion 91 and the second tubular portion 92. The first tubular portion 91 and the second tubular portion 92 are substantially coaxially arranged through the slide contact between the first guiding part 93 of the first tubular portion 91 and the second guiding part 94 of the second tubular portion 92. In this way, the plate thickness (the radial thickness) of the seal member 96 becomes generally uniform along the entire circumferential extent of the seal member 96, so that the leakage of the oil from the oil accumulation chamber 90 can be reliably limited.

(4) In the first embodiment, the oil discharge passage 131 of the camshaft 13 and the oil accumulation chamber 90 are communicated with each other through the front groove and hole portion 421, the inside passage 47, the slide chamber 44 and the axial passage 45 of the hydraulic pressure control valve 40. In this way, the oil, which is accumulated in the oil accumulation chamber 90, can be discharged to the oil discharge passage 131 of the camshaft 13. Thus, the leakage of the oil from the oil accumulation chamber 90 can be reliable limited by limiting the pressure increase of the oil accumulation chamber 90.

(5) In the first embodiment, the gap 10, which enables the coaxial alignment, is provided between the solenoid main body 51 and the inner peripheral wall **6*a* of the installation hole 6 of the engine cover 3, to which the solenoid main body 51 is installed. In this way, the housing 20 and the solenoid 50** can be reliably coaxially aligned with each other through the fitting between the first tubular portion 91 and the second tubular portion 92.

Second Embodiment

Figure 5:
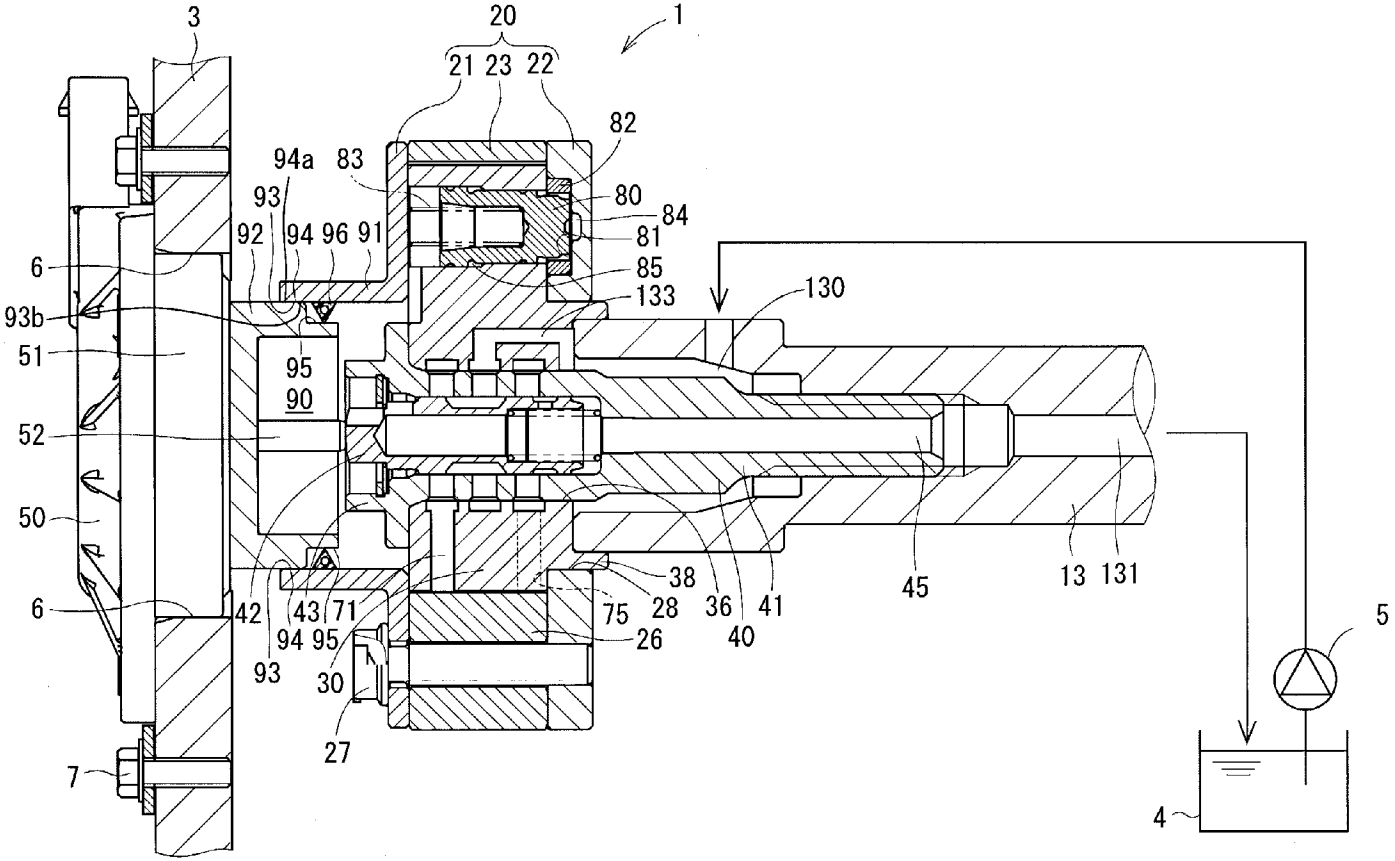
FIG. 5 is a longitudinal cross sectional view of a valve timing control apparatus according to a second embodiment of the present disclosure.

FIG. 5 shows a second embodiment of the present disclosure. In the following embodiments, the components, which are similar to those of the first embodiment, will be indicated by the same reference numerals and will not be described again for the sake of simplicity.

In the second embodiment, the first tubular portion 91, which extends from the housing 20, is fitted to the outer peripheral wall (the radially outer side section) of the second tubular portion 92, which extends from the solenoid main body 51. Specifically, an inner peripheral wall section (also referred to as a radially inner side section) 93*b* of the first guiding part 93, which is formed as a part of the inner peripheral wall of the first tubular portion 91, slidably contacts an outer peripheral wall section (also referred to as a radially outer side section) 94*b* of the second guiding part 94, which is formed as a part of the outer peripheral wall of the second tubular portion 92. Thereby, the housing 20 is substantially coaxially aligned with the solenoid 50.

The second tubular portion 92 includes the stepped part 95, which has the inner diameter that is smaller than the inner diameter of the second guiding part 94. The seal member 96 is fixed to the inner peripheral wall of the first tubular portion 91, which is opposed to the stepped part 95, by, for example, press-fitting. The seal surface 97 of the seal member 96 fluid-tightly and slidably contacts the stepped part 95 of the second tubular portion 92. In this way, the leakage of the oil from the oil accumulation chamber 90 is limited.

According to the second embodiment, the advantages, which are similar to those of the first embodiment, are achieved.

Third Embodiment

Figure 6:
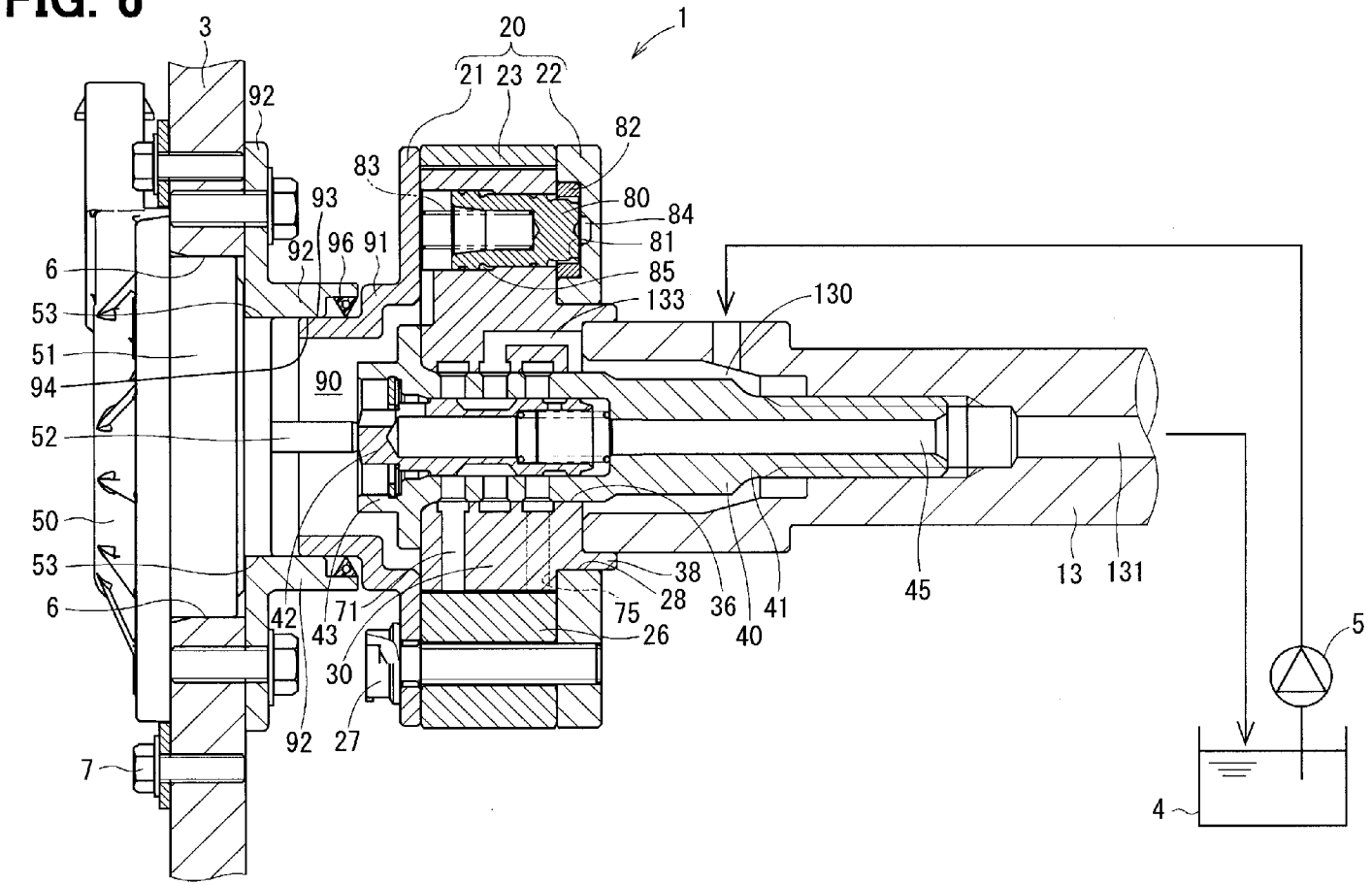
FIG. 6 is a longitudinal cross sectional view of a valve timing control apparatus according to a third embodiment of the present disclosure.

FIG. 6 shows a third embodiment of the present disclosure, which is a modification of the first embodiment. In the third embodiment, the second tubular portion 92 is formed separately from the solenoid main body 51 and is installed to the engine cover 3. The inner peripheral wall of the second tubular portion 92 contacts a cylindrical tubular portion 53 of the solenoid main body 51. The cylindrical tubular portion 53 and the press pin 52 are substantially coaxial with each other. Thereby, the second tubular portion 92 and the solenoid 50 are substantially coaxially installed.

The housing 20 and the second tubular portion 92 are held substantially coaxial with each other through the slide contact between the first guiding part 93 of the first tubular portion 91 and the second guiding part 94 of the second tubular portion 92. Since the second tubular portion 92 and the solenoid 50 are substantially coaxial with each other, the housing 20 and the solenoid 50 are substantially coaxial with each other. In this way, the press pin 52 of the solenoid 50 can reliably press the spool 42 of the hydraulic pressure control valve 40, which is placed along the rotational axis Oa of the housing 20.

According to the third embodiment, the advantages, which are similar to those of the first and second embodiments, are achieved.

Fourth Embodiment

Figure 7:
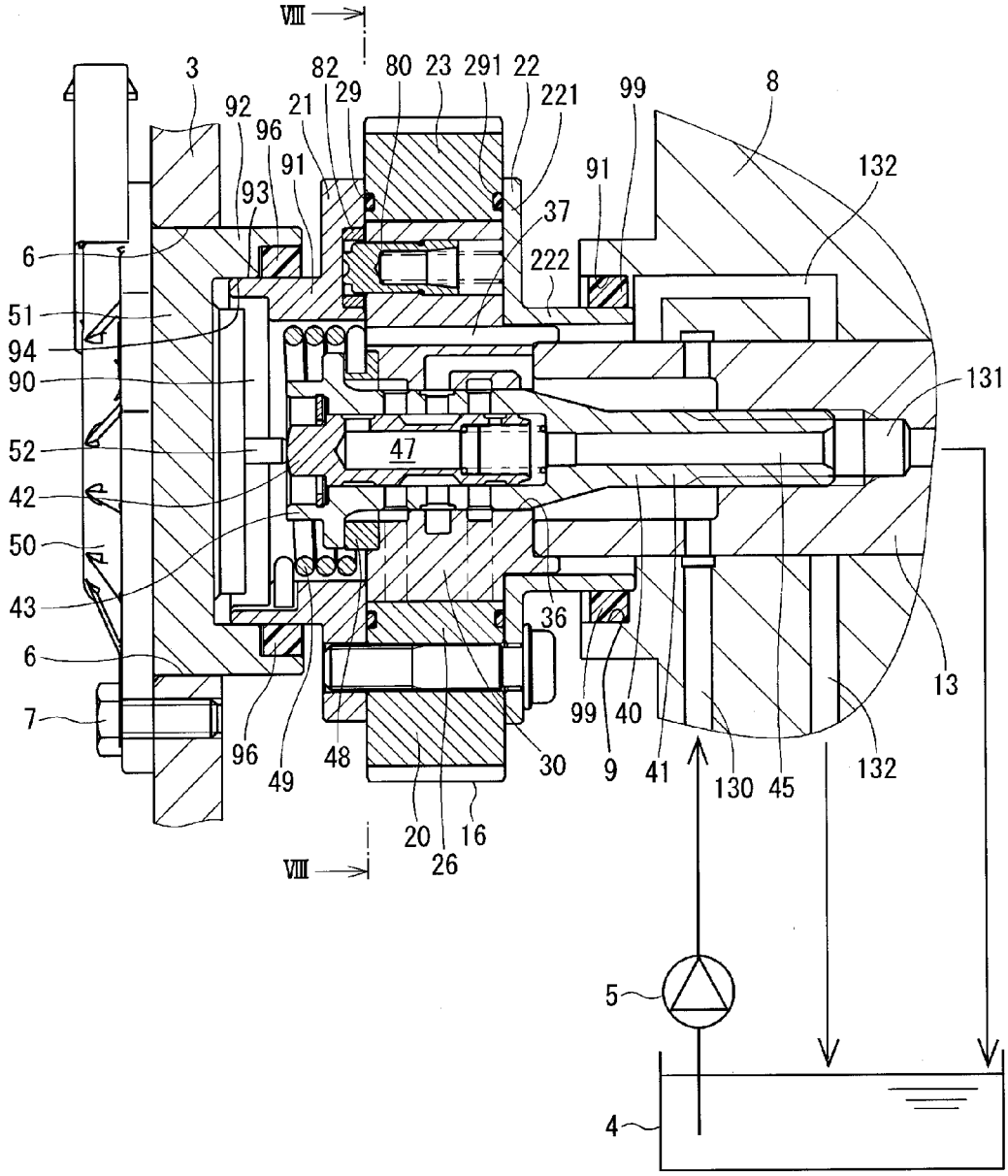
FIG. 7 is a longitudinal cross sectional view of a valve timing control apparatus according to a fourth embodiment of the present disclosure.
Figure 8:
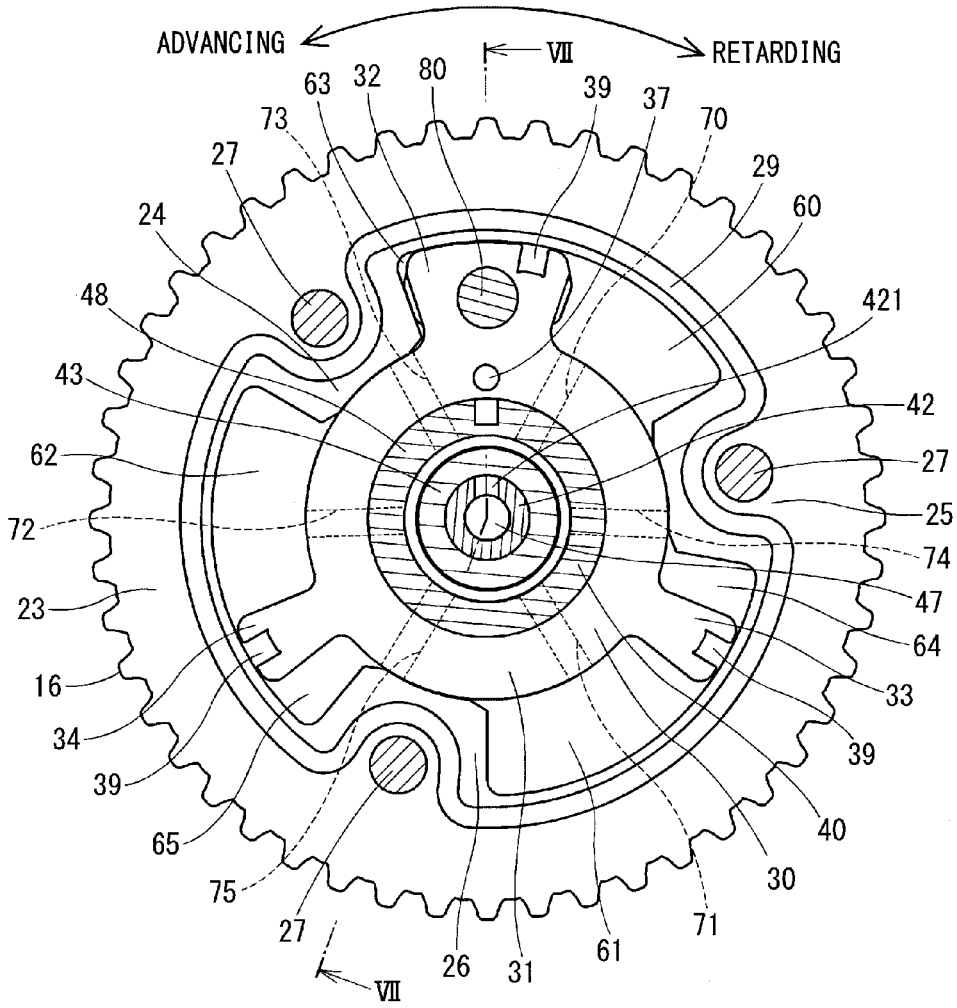
FIG. 8 is a cross sectional view taken along line VIII-VIII in FIG. 7.
Figure 9:
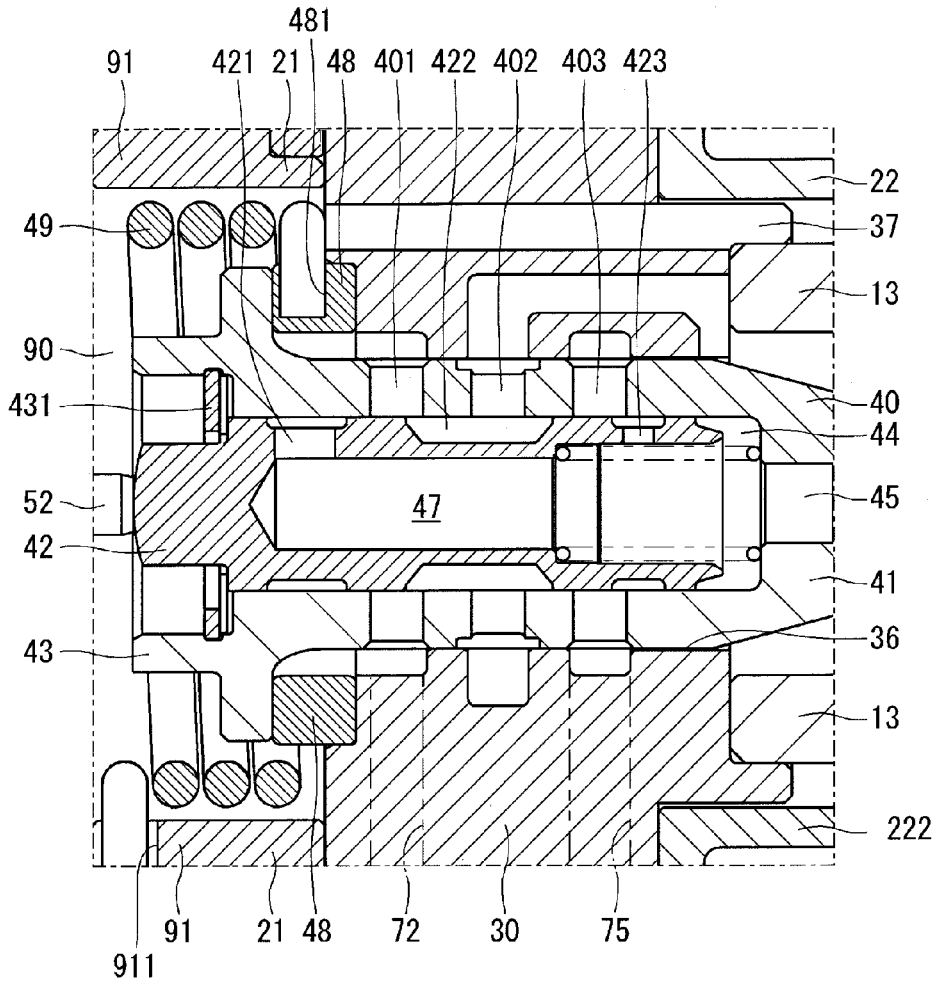

FIGS. 7 to 9 show a fourth embodiment of the present disclosure. The valve timing control apparatus of the fourth embodiment adjusts the opening timing and closing timing of the exhaust valves 19.

In the housing 20, a seal member 29 is held between the front plate 21, which is located on the front side of the seal member 29, and the tubular portion 23 and the shoes 24, 26, which are located on the rear side of the seal member 29. Furthermore, a seal member 291 is held between the rear plate 22, which is located on the rear side of the seal member 291, and the tubular portion 23 and the shoes 24-26, which are located on the front side of the seal member 291. In this way, leakage of the oil to the outside of the housing 20 can be limited.

The rear plate 22 includes an annular portion 221 and a cylindrical tubular portion 222. The annular portion 221 is configured into an annular form (a ring form). The cylindrical tubular portion 222 axially extends from a radially inner part (an inner peripheral edge) of the annular portion 221 toward an engine head 8.

The cylindrical tubular portion 222 is fitted into a recess 9 of the engine head 8. The cylindrical tubular portion 222 is installed to the engine head 8 in a rotatable manner.

A seal member 99 is installed between an outer peripheral wall of the cylindrical tubular portion 222 of the rear plate 22 and an inner peripheral wall of the recess 9 of the engine head 8. The seal member 99 limits leakage of the oil thought the gap(s) between the cylindrical tubular portion 222 of the rear plate 22 and the engine head 8.

The vane rotor 30 includes a second communication passage 37, which extends through the vane rotor 30 in the direction of the rotational axis. One end of the second communication passage 37 of the vane rotor 30 opens to an inside of the first tubular portion 91, and the other end of the second communication passage 37 opens to an inside of the cylindrical tubular portion 222 of the rear plate 22. The space in the inside of the cylindrical tubular portion 222 of the rear plate 22 is communicated with a second oil discharge passage 132 of the engine head 8. Therefore, the oil accumulation chamber 90 is communicated with the second oil discharge passage 132 of the engine head 8 through the second communication passage 37 of the vane rotor 30 and the space in the inside of the cylindrical tubular portion 222 of the rear plate 22.

An annular member 48 is installed between the head 43 of the sleeve 41 and the vane rotor 30. A return spring 49 is installed at an outside of the head 43 of the sleeve 41. One end portion of the return spring 49 is engaged with a groove 481 of the annular member 48, and the other end portion of the return spring 49 is engaged with a groove 911 formed in the inner peripheral wall of the first tubular portion 91. The return spring 49 urges the vane rotor 30 in the advancing direction.

The spool 42 has a front groove and hole portion 421, a middle groove portion 422 and a rear groove and hole portion 423, which are formed in the outer peripheral wall of the spool 42 and are arranged in this order from the front side to the rear side in the axial direction.

The front groove and hole portion 421 is communicated with the inside passage 47 and is not opened to the oil accumulation chamber 90.

The middle groove portion 422 and the rear groove and hole portion 423 are similar to the middle groove portion 422 and the rear groove and hole portion 423 of the first to third embodiments.

The second tubular portion 92, which extends from the solenoid main body 51 toward the housing 20, is fitted to the first tubular portion 91 to form the oil accumulation chamber 90, and this oil accumulation chamber 90 accumulates the oil, which is leaked from the gap(s) between the housing 20 and the vane rotor 30. In the fourth embodiment, the oil is not directly discharged from the advancing oil passages 70-72 or the retarding oil passages 73-75 into the oil accumulation chamber 90.

Next, the operation of the valve timing control apparatus of the fourth embodiment will be described.

(Engine Start Time)

As shown in FIGS. 7 and 8, in the state where the engine 2 is stopped, the stopper piston 80 is receive in the inside of the ring 82, and the vane rotor 30 is held in the most retarded position relative to the housing 20.

(After Engine Start)

After the start of the engine 2, when the sufficient amount of oil is supplied to each corresponding hydraulic chamber from the oil pump 5, the stopper piston 80 is removed from the ring 82. Thereby, the rotation of the vane rotor 30 relative to the housing 20 is enabled.

(Time of Retarding Operation)

In the retarding operation of the valve timing control apparatus, the solenoid 50 receives the corresponding command from the ECU and drives the press pin 52 to press the spool 42 of the hydraulic pressure control valve 40 toward the spring 46. In this way, the oil is supplied from the hydraulic pressure supply passage 130 to the retarding chambers 63-65 through the second port 402, the third port 403 and the retarding oil passages 73-75. In contrast, the oil of the advancing chambers 60-62 is discharged to the inside passage 47 through the advancing oil passages 70-72, the first port 401 and the front groove and hole portion 421. In this way, the hydraulic pressure of the retarding chambers 63-65 is applied to the vanes 32-34, and thereby the vane rotor 30 is rotated relative to the housing 20 in the retarding direction.

(Time of Advancing Operation)

In the advancing operation of the valve timing control apparatus, the solenoid 50 receives the corresponding command from the ECU and removes the press force, which drives the press pin 52, so that the press force of the press pin 52, which presses the spool 42 of the hydraulic pressure control valve 40 toward the spring 46, is removed. In this way, the oil is supplied from the hydraulic pressure supply passage 130 to the advancing chambers 60-62 through the second port 402, the first port 401 and the advancing oil passages 70-72. In contrast, the oil of the retarding chambers 63-65 is discharged to the inside passage 47 through the retarding oil passages 73-75, the third port 403, and the rear groove and hole portion 423. In this way, the hydraulic pressure of the advancing chambers 60-62 is applied to the vanes 32-34, and thereby the vane rotor 30 is rotated relative to the housing 20 in the advancing direction.

(Time of Engine Stop)

When the command, which stops the engine 2, is outputted during the operating period of the valve timing control apparatus, the vane rotor 30 is rotated relative to the housing 20 in the retarding direction through the operation, which is similar to the retarding operation discussed above, and the vane rotor 30 is stopped in the most retarded position. In this state, when the operation of the oil pump 5 is stopped to cause a reduction in the pressure of the first pressure chamber 84 and a reduction in the pressure of the second pressure chamber 85, the stopper piston 80 is urged into the inside of the ring 82 by the urging force of the spring 83. In this state, the engine 2 is stopped.

Now, the advantages of the fourth embodiment will be described.

(1) In the fourth embodiment, the vane rotor 30 has the second communication passage 37 that communicates between the second oil discharge passage 132, which is formed in the engine head 8, and the oil accumulation chamber 90. Thereby, the oil, which is accumulated in the oil accumulation chamber 90, can be outputted to the second oil discharge passage 132 of the engine head 8 through the second communication passage 37. Thus, the leakage of the oil from the oil accumulation chamber 90 can be reliable limited.

(2) In the fourth embodiment, the oil, which is discharged from the advancing oil passages 70-72 or the retarding oil passages 73-75, flows from the first port 401 or the third port 403 of the sleeve 41 to the oil discharge passage 131 of the camshaft 13 through the inside passage 47 in the spool 42 without passing through the oil accumulation chamber 90.

In this way, the hydraulic pressure, which is applied from the oil accumulation chamber 90 to the vane rotor 30, is reduced, and thereby the frictional force between the vane rotor 30 and the housing 20 is reduced.

Furthermore, since the oil pressure, which is applied from the oil accumulation chamber 90 to the solenoid 50, is reduced, the reliability of the solenoid 50 can be improved.

Furthermore, the pressure loss of the oil, which flows from the advancing chambers 60-62 or the retarding chambers 63-65 to the oil discharge passage 131, is reduced.

Thus, the response of the phase control operation of the vane rotor 30 relative to the housing 20 can be improved.

Now, modifications of the above embodiments will be described.

In the above embodiments, the oil passages, which are communicated with the first port 401 of the hydraulic pressure control valve 40, are advancing oil passages 70-72. Furthermore, the oil passages, which are communicated with the third port 403 of the hydraulic pressure control valve 40, are the retarding oil passages 73-75. Alternatively, in a modification of the above embodiments, the oil passages, which are communicated with the first port 401 of the hydraulic pressure control valve 40, may be retarding oil passages 73-75, and the oil passages, which are communicated with the third port 403 of the hydraulic pressure control valve 40, may be the advancing oil passages 70-72.

The present disclosure is not limited to the above embodiments, and the above embodiments may be further modified according to the principle of the present disclosure. For example, any one or more of the above features of any one of the embodiments may be combined with any one or more of the above features of any other one or more of the above embodiments.

What is claimed is:

1. A valve timing control apparatus that controls opening timing and closing timing of one of an intake valve and an exhaust valve of an internal combustion engine, which is opened and closed by a driven-side shaft of the internal combustion engine, through changing of a rotational phase between a driving-side shaft of the internal combustion engine and the driven-side shaft, the valve timing control apparatus comprising:

a housing that is rotatable integrally with the driving-side shaft;

a vane rotor that is rotatable relative to the housing according to a hydraulic pressure of an advancing chamber formed in the housing and a hydraulic pressure of a retarding chamber formed in the housing, wherein the vane rotor is fixed to the driven-side shaft;

a hydraulic pressure control valve that includes:

a sleeve that is received in a center hole of the vane rotor, which extends in a direction of a rotational axis of the vane rotor; and a spool that is received in an inside of the sleeve and is configured to reciprocate along the sleeve, wherein the hydraulic pressure control valve changes a hydraulic pressure, which is supplied to or is discharged from the advancing chamber, and a hydraulic pressure, which is supplied to or is discharged from the retarding chamber, through movement of the spool;

a solenoid that includes:

a solenoid main body that is opposed to the housing; and a press pin that projects from the solenoid main body and is configured to press the spool of the hydraulic pressure control valve, wherein the solenoid controls the changing of the hydraulic pressures at the hydraulic pressure control valve;

a first tubular portion that extends from the housing toward the solenoid; and a second tubular portion that extends from the solenoid main body or an installation member, to which the solenoid main body is installed, toward the housing and is fitted to the first tubular portion, wherein the second tubular portion cooperates with the first tubular portion to form an oil accumulation chamber that is configured to accumulate at least one of:

oil outputted from a gap between the housing and the vane rotor; and oil discharged from an oil passage communicated with the advancing chamber or the retarding chamber.

2. The valve timing control apparatus according to claim 1, wherein:

the first tubular portion includes a first guiding part that is configured into a cylindrical tubular form and slidably contacts the second tubular portion;

the second tubular portion includes a second guiding part that is configured into a cylindrical tubular form and slidably contacts the first tubular portion; and the first guiding part and the second guiding part slidably contact with each other to substantially place a rotational axis of the housing and a central axis of the press pin along a common axis.

3. The valve timing control apparatus according to claim 1, wherein the second guiding part slidably contacts one of a radially outer side section and a radially inner side section of the first guiding part.

4. The valve timing control apparatus according to claim 1, wherein a seal member, which is configured into an annular form, is placed between the first tubular portion and the second tubular portion to limit leakage of oil from the oil accumulation chamber.

5. The valve timing control apparatus according to claim 1, wherein the solenoid main body and the second tubular portion are integrally formed.

6. The valve timing control apparatus according to claim 1, wherein a gap is formed between the solenoid main body and an inner peripheral wall of an installation hole of the installation member to enable adjustment of alignment between a rotational axis of the housing and a central axis of the press pin.

7. The valve timing control apparatus according to claim 1, wherein the hydraulic pressure control valve includes a communication passage that communicates between the oil accumulation chamber and an oil discharge passage that is formed in the driven-side shaft.

8. The valve timing control apparatus according to claim 1, wherein the vane rotor includes a second communication passage that communicates between the oil accumulation chamber and a second oil discharge passage, which is formed in an engine head of the internal combustion engine fluid-tightly fitted to the housing.

9. The valve timing control apparatus according to claim 8, wherein the oil, which is discharged from the advancing chamber, and the oil, which is discharged from the retarding chamber, are conducted to an oil discharge passage, which is formed in the driven-side shaft, through a port of the sleeve, a groove and hole portion of the spool and an inside passage of the spool without passing through the oil accumulation chamber.

* * * * *